US008329616B2

(12) United States Patent
Majumdar et al.

(10) Patent No.: US 8,329,616 B2
(45) Date of Patent: Dec. 11, 2012

(54) IMAGE RECEIVER ELEMENTS WITH OVERCOAT

(75) Inventors: Debasis Majumdar, Rochester, NY (US); Narasimharao Dontula, Rochester, NY (US); Kevin M. Ryan, Brockpot, NY (US); Somsack Chang, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 458 days.

(21) Appl. No.: 12/750,733

(22) Filed: Mar. 31, 2010

(65) Prior Publication Data

US 2011/0244149 A1 Oct. 6, 2011

(51) Int. Cl.
*B41M 5/50* (2006.01)

(52) U.S. Cl. ..... 503/227

(58) Field of Classification Search ..... None
See application file for complete search history.

(56) References Cited

U.S. PATENT DOCUMENTS

| | | | | |
|---|---|---|---|---|
| 4,775,657 | A | 10/1988 | Harrison et al. | |
| 5,128,313 | A | 7/1992 | Aono | |
| 6,825,150 | B2 * | 11/2004 | Smith et al. | 503/227 |
| 2008/0220190 | A1 | 9/2008 | Majumdar et al. | |

FOREIGN PATENT DOCUMENTS

| | | | |
|---|---|---|---|
| EP | 0 551 894 | A1 | 7/1993 |
| WO | WO 2008/108911 | A1 | 9/2008 |

OTHER PUBLICATIONS

U.S. Appl. No. 12/533,081, filed Jul. 31, 2009, titled "Image Receiver Elements With Aqueous Dye Receiving Layer" by Majumdar et al.
U.S. Appl. No. 12/548,476, filed Aug. 27, 2009, titled "Image Receiver Elements" by Dontula et al.

* cited by examiner

*Primary Examiner* — Bruce H Hess
(74) *Attorney, Agent, or Firm* — J. Lanny Tucker

(57) ABSTRACT

An image receiving element has an extruded compliant layer, an extruded image receiving layer, and a topcoat immediately adjacent the extruded image receiving layer. The extruded image receiving layer is non-crosslinked and has a glass transition temperature ($T_g$) of from about 40° C. to about 80° C. whereas the topcoat is an aqueous-coated layer and has a $T_g$ that is within a range of plus or minus 10° C. of the $T_g$ of the extruded image receiving layer. The dry thickness ratio of the topcoat to the extruded image receiving layer is from 1:2 to 1:20.

20 Claims, No Drawings

IMAGE RECEIVER ELEMENTS WITH OVERCOAT

FIELD OF THE INVENTION

The present invention relates to image receiver elements such as thermal dye transfer receiver elements in which an extruded receiver layer is overcoated with an aqueous-coated topcoat.

BACKGROUND OF THE INVENTION

In recent years, thermal transfer systems have been developed to obtain prints from pictures that have been generated from a camera or scanning device. According to one way of obtaining such prints, an electronic picture is first subjected to color separation by color filters. The respective color-separated images are then converted into electrical signals. These signals are then transmitted to a thermal printer. To obtain the print, a cyan, magenta or yellow dye-donor element is placed face-to-face with a dye receiver element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other colors. A color hard copy is thus obtained which corresponds to the original picture viewed on a screen.

Thermal dye receiver elements used in thermal dye transfer generally include a support (transparent or reflective) bearing on one side thereof a dye image-receiving layer, and optionally additional layers, such as a compliant or cushioning layer between the support and the dye receiving layer. The compliant layer provides insulation to keep heat generated by the thermal head at the surface of the print, and also provides close contact between the donor ribbon and receiving sheet which is essential for uniform print quality. Various approaches have been suggested for providing such a compliant layer. U.S. Pat. No. 5,244,861 (Campbell et al.) describes a composite film comprising a microvoided core layer and at least one substantially void-free thermoplastic skin layer. Such an approach adds an additional manufacturing step of laminating the composite film to the support, and film uniformity can be variable resulting in high waste factors. U.S. Pat. No. 6,372,689 (Kuga et al.) describes the use of a hollow particle layer between the support and dye receiving layer. Such hollow particles layers are frequently coated from aqueous solutions that necessitate a powerful drying stage in the manufacturing process and can reduce productivity. In addition, the hollow particles can result in increased surface roughness in the finished print that reduces surface gloss. It would be advantageous to provide a compliant layer that enables a high gloss print to be obtained. It would also be advantageous if the technology used to provide such a compliant layer also enables a matte-like print to be obtained if a low gloss finish is desired. It would be further advantageous if this low gloss finish can further be enhanced by the incorporation of additives like matte beads in an aqueous subbing layer.

Known polymer composite laminates used on the faceside (imaging side) of dye-thermal receiver elements have a top skin layer of polypropylene (PP) onto which can be extruded a dye receiver layer (DRL), or an image receiving layer, containing a polyester/polycarbonate blend.

Copending and commonly assigned U.S. Ser. Nos. 12/490,464 and 12/490,464 (both filed Jun. 24, 2009 by Dontula et al.) describe imaging elements having multiple extruded layers included extruded compliant and antistatic subbing layers. Two or more of such layers can be co-extruded if desired along with optional extruded skin layers.

In addition, copending and commonly assigned U.S. Ser. No. 11/681,802 (filed Mar. 5, 2007 by Majumdar and Dontula) describes image recording elements comprising a support having thereon an aqueous subbing layer and an extruded dye receiving layer.

U.S. Pat. No. 4,775,657 (Harrison et al.) describes the use of organic solvent-coated overcoats in thermal dye transfer elements, which overcoats containing polycondensation polymers having a glass transition temperature that is at least 40° C. less than the $T_g$ of the organic solvent-coated dye image receiving layer. This difference in $T_g$ tends to cause sticking of the element during thermal dye transfer. In addition, because of the high $T_g$ of the dye image receiving layer polycarbonate, these elements tend to exhibit dye instability and unwanted dye migration While aqueous antistatic layers have been inserted between extruded compliant layers and extruded image receiving layers, there is a desire to avoid such layers if possible. In addition, there is a desired to use less expensive and easily applied (extruded) image receiving layers that are simple in construction and yet can be readily used for thermal printing without jamming in printers.

SUMMARY OF THE INVENTION

The present invention provides an image receiving element comprising a substrate and having thereon an extruded compliant layer, an extruded image receiving layer, and a topcoat immediately adjacent the extruded image receiving layer, wherein:

the extruded image receiving layer is non-crosslinked and has a glass transition temperature ($T_g$) of from about 40° C. to about 80° C., the topcoat is an aqueous-coated layer and has a polymer that has a $T_g$ that is within a range of plus or minus 20° C. of the $T_g$ of the extruded image receiving layer, which polymer comprises at least 20 weight % of the total polymers in the topcoat, and the dry thickness ratio of the topcoat to the extruded image receiving layer is from 1:2 to 1:100.

This invention also provides a method of forming a dye image comprising:

thermally transferring a dye image from a thermal dye donor element to the imaging element of this invention that is a thermal dye transfer receiver element.

In some embodiments, the element of this invention comprises an extruded thermal dye transfer receiving layer and the element is a thermal dye transfer receiver element.

The image receiving elements of this invention can be used in an assembly with an image donor element, for example as an assembly of a thermal dye transfer receiver element and a thermal dye donor element.

The elements of the present invention can be used to provide an image or material, where the image can be borderless or have a border.

The present invention includes several advantages, not all of which are provided with a single embodiment.

The present invention provides image receiving elements that are simpler in layer composition, especially with regard to the extruded image receiving layer. This layer is non-crosslinked and in most embodiments consists essentially of polyester polymeric binders, and especially only aliphatic polyesters or polyesters comprising (a) recurring dibasic acid derived units and diol derived units, at least 50 mole % of the dibasic acid derived units comprising dicarboxylic acid derived units containing an alicyclic ring comprising 4 to 10 ring carbon atoms, which ring is within two carbon atoms of each carboxyl group of the corresponding dicarboxylic acid, (b) 25 to 75 mole % of the diol derived units containing an aromatic ring not immediately adjacent to each hydroxyl group of the corresponding diol or an alicyclic ring, and (c) 25 to 75 mole % of the diol derived units of the polyester contain an alicyclic ring comprising 4 to 10 ring carbon atoms. This is possible because of the presence of the relatively thinner topcoat disposed on the image receiving layer. This topcoat comprises a polymer that is specifically designed to be crosslinked, to have a glass transition temperature close to that of the image receiving layer, and is especially composed of an aqueous polyester or a polyurethane, or both.

It is also advantageous that some embodiments also contain an extruded "skin" layer that is immediately adjacent on either or both sides of the extruded compliant layer. In most instances, these skin layers are co-extruded with the compliant layer to provide manufacturing efficiencies.

DETAILED DESCRIPTION OF THE INVENTION

Definitions

Unless otherwise indicated, the terms "image receiving element", "thermal dye transfer receiver element", and "receiver element" refer to embodiments of the present invention.

The present invention relates to a multilayer element that is useful as an image receiving element. This element essentially includes at least an extruded image receiving layer (IRL), an extruded compliant layer, an aqueous-coated topcoat, and a substrate upon which the layers are disposed. Optionally, one or more extruded skin layers can be located immediately adjacent on either or both surfaces of the extruded compliant layer and there can be an antistatic layer between the extruded compliant layer and the extruded image receiving layer, but is preferable that this layer is omitted.

As used herein, the term "imaging element" comprises the various layers described herein and at least one image receiving layer and can be used in multiple techniques governing the thermal transfer of an image onto the imaging element. Such techniques include thermal dye transfer, electrophotographic printing, thermal wax transfer (or phase change imaging), or inkjet printing. The imaging elements can be designed for reflection viewing, that is having an opaque support, or designed for viewing by transmitted light, that is having a transparent support.

The terms as used herein, "top", "upper", and "face" mean the side or toward the side of the image receiving element bearing the imaging layers, image, or layer receiving the image.

The terms "bottom", "lower side", and "back" refer to the side or toward the side of the image receiving element opposite from the side bearing the imaging layers, image, or layer receiving the image.

The term "non-voided" is used to refer to a layer as being devoid of added solid or liquid matter or voids containing a gas.

The term "voided polymers" will include materials comprising microvoided polymers and microporous materials known in the art. A foam or polymer foam formed by means of a blowing agent is not considered a voided polymer for purposes of the present invention.

"Image receiving layer" (IRL) can be a "dye receiving layer" (DRL) or "thermal dye image receiving layer".

The term "aqueous-coated" refers to layers coated from a coating formulation wherein the coating medium is substantially (at least 50 weight %) water.

Compliant Layer

The extruded compliant layer present in the image receiving element comprises one or more elastomeric polymers such as a thermoplastic polyolefin blend, styrene/alkylene block copolymer, polyether block polyamide, copolyester elastomer, or thermoplastic urethane. Generally, the compliant layer comprises multiple resins, some of which are desirably elastomeric including but not limited to, thermoplastic elastomers like polyolefin blends, styrene block copolymers (SBC) like styrene-ethylene/butylene styrene (SEBS) or styrene-ethylene/propylene styrene (SEPS) or styrene butadiene styrene (SBS) or styrene isoprene styrene (SIS), polyether block polyamide (Pebax® type polymers), thermoplastic copolyester elastomer (COPE), thermoplastic urethanes (TPU) and semicrystalline polyolefin polymers such as ethylene/propylene copolymers (for example, available as Vistamaxx™ polymers). One or more elastomeric resins are present in an amount of from about 15 to about 50 weight %, or typically from about 15 to about 40 weight %, based on the total dry weight of the compliant layer.

For example, the compliant layer can comprise from about 15 to about 50 weight % of a thermoplastic polyolefin blend, styrene/alkylene block copolymer, polyether block polyamide, copolyester elastomer, ethylene/propylene copolymer, or thermoplastic urethane, or a mixture thereof.

The compliant layer generally also includes one or more "matrix" polymers that are not generally elastomeric. Such polymeric materials include but are not limited to, polyolefins such as polyethylene, polypropylene, their copolymers, functionalized or grafted polyolefins, polystyrene, polyamides like amorphous polyamide (like Selar), and polyesters. The amount of one or more matrix polymers in the compliant layer is generally from about 35 to about 80 weight % or typically from about 40 to about 65 weight %.

In some embodiments, the compliant layer also includes a third component that is an additive amorphous or semi-crystalline polymer such as cyclic olefins, polystyrenes, maleated polyethylene (such as Dupont Bynel® grades, Arkema's Lotader® grades), and polypropylene that can be present in an amount of from about 2 to about 25 weight %, or typically from about 5 to about 20 weight %.

Depending on the manufacturing process and thickness of the extruded compliant layer, the various types of resins are used individually or in mixtures or blends. For example, useful compliant layer resin blends include blends of ethylene/ethyl acrylate copolymers (EEA), ethylene/butyl acrylate copolymers (EBA), or ethylene/methyl acrylate copolymers (EMA) with SEBS like Kraton® G1657M; EEA, EBA, or EMA with SEBS and polypropylene; EEA, EBA, or EMA polymers with SEBS and polystyrene; EEA or EMA with SEBS and cyclic polyolefins (like Topas); polypropylene or blends of polypropylene with Kraton® polymers like FG1924, G1702, G1730M; polypropylene or blends of polypropylene with ethylene propylene copolymers like Exxon Mobil's Vistamaxx™ grades; or blends of low density polyethylene (LDPE) with amorphous polyamide like Dupont's Selar and Kraton® FG grade of polymers or an additive compound such as maleated polyethylene (Dupont Bynel® grades, Arkema's Lotader® grades).

For example, some embodiments include combinations of polymers in the extruded compliant layer that comprise from about 40 to about 65 weight % of a matrix polymer, from about 15 to about 40 weight % of the elastomeric polymer, and from about 5 to about 20 weight % of an amorphous or semi-crystalline polymer additive. The weight ratio of the three components can be varied and optimized based on the layer structure and the resins used.

The resin compositions in the extruded compliant layer are optimized for printer performance as well as ability to manufacture at high speeds using a high temperature process like extrusion coating. Extrusion requires the resins to have thermal stability, must have the ability to be drawn down, have the appropriate shear viscosity and melt strength, and must have good release from a chill roll. The shear viscosity range of the compliant layer resins and resin blends should be from about 1,000 poise to about 100,000 poise at 200° C. at a shear rate of 1 $s^{-1}$, or from about 2,000 poise to about 50,000 poise at 200° C. at a shear rate of 1 $s^{-1}$.

The final dry thickness of the extruded compliant layer is generally from about 15 μm to about 70 μm or typically from about 20 μm to about 45 μm.

By "extruded" in reference to the compliant layer, we mean to include films that are extruded, biaxially oriented, and then laminated onto the support (described below) that can include skin layers disposed on the raw paper base of the support.

Alternatively, the compliant layer can be directly extruded onto the support, with or without extruded skin layers, as described below. For example, the compliant layer and a skin layer can be co-extruded onto the raw paper base if desired. The compliant layer can also be co-extruded with the image receiving layer.

In either case, the compliant layer resin formulation can be extruded using high temperature extrusion processes like cast extrusion or extrusion coating or hot melt at a temperature of from about 200° C. to about 285° C. at an extrusion speed of from about 0.0508 m/sec to about 5.08 m/sec. Useful extrusion speeds are high speeds due to productivity constraints and for economical reasons. In some instances, the resulting compliant layer can be extruded at a thickness greater than the final thickness at slow speeds, but then stretched or made thinner by an orientation process that results in coating on a support at a higher speed.

The extruded compliant layer can also include additives such as opacifiers like titanium dioxide, calcium carbonate, colorants, dispersion aids like zinc stearate, chill roll release agents, antioxidants, UV stabilizers, and optical brighteners.

Alternatively, the aforesaid extruded compliant layer can be a voided layer that can be surrounded on either side with a skin layer. This voided layer can be incorporated in the substrate in the form of a biaxially oriented polymer sheet comprising a voided layer such as those described in detail in U.S. Pat. No. 5,244,861 (noted above) that is incorporated herein by reference. Alternatively or additionally, the voided layer can comprise hollow particles such as the commercially available Expancel® microspheres (Akzo Nobel), with capsule walls made of thermoplastic materials such as vinylidene chloride-acrylonitrile copolymers and a volatile expanding agent, such as propane, n-butane, and iso-butane in the inside of individual particles. Furthermore, the extruded compliant layer can comprise a foamed polymer core as described below for the supports and as described for example in U.S. Pat. No. 6,537,656 (Dontula et al.) and U.S. Pat. No. 7,585,557 (Aylward et al.), both of which are incorporated herein by reference.

Thus, the extruded compliant layer can be a non-voided, voided, or foamed film as those features are provided using known techniques and components.

Skin Layer(s)

The imaging element can also include one or more skin layers, on either or both sides of the extruded compliant layer. Such skin layers can be composed of polyolefins such as polyethylene, copolymers of ethylene, like ethylene/methyl acrylate (EMA) copolymers, ethylene/butyl acrylate (EBA) copolymers, ethylene/ethyl acrylate (EEA) copolymers, ethylene/methyl acrylate/maleic anhydride copolymers, or blends of these polymers. The acrylate content in the skin should be so adjusted that it does not block in roll form, or antiblock additives can be added to the layer formulation. Different skin layers can be used on opposite sides of the extruded compliant layer. Elastomers (as described above for the extruded compliant layer) can be present in the skin layers if desired.

The thickness of the image side skin layer can be from up to 10 μm and typically up to 8 μm. The resin choice and the overall composition of the topmost surface of the support is optimized to obtain good adhesion to the aqueous-coated subbing layer and enable good chill roll or casting wheel release.

A skin layer on the support side of the extruded compliant layer can be similarly composed and have a thickness of up to 70 μm, and typically up to 15 μm.

The skin layers can be extruded individually at high temperatures of from about 200° C. to about 285° C. at speeds of from about 0.0508 m/sec to about 5.08 m/sec. Alternatively, they can be co-extruded (extruded simultaneously) with the compliant layer and cast on a chill roll, casting wheel, or cooling stack. A particularly useful configuration is the presence of a skin layer on the topmost surface of the support.

Image Receiving Layer

The image receiving layer used in the imaging element is extruded using extrusion coating procedures described above for extrusion of the compliant and skin layers. In most embodiments, the image receiving layer (such as a thermal dye image receiving layer) is extruded onto the extruded compliant layer without any intervening layers. The two layers can be co-extruded. The details of such image receiving layers are provided for example in U.S. Pat. No. 7,091,157 (Kung et al.) that is incorporated herein by reference. In general, the extruded image receiving layer is non-crosslinked and has a glass transition temperature ($T_g$) of from about 40° C. to about 80° C., or from about 40° C. to about 75° C., or more particularly from about 40° C. to about 65° C. as measured by thermal analysis techniques like differential scanning colorimetry using instrumentation that is available from Perkin Elmer, TA Instruments, or Mettler Toledo. Thus, the "layer" $T_g$ is a measurement of the $T_g$ of the extrudable layer formulation that may include one or more different polymers or components as described below.

By "non-crosslinked", we mean that the layer is not purposely crosslinked nor are crosslinking agents purposely added and the resin flows when heated above its transition temperature ($T_g$) or melting point ($T_m$). However, there can be some inadvertent crosslinking due to the high temperature conditions used for extrusion.

Useful resins for the extruded image receiving layer include but are not limited to, polycarbonates, polyurethane, polyesters, polyolefins, polyvinyl chloride, poly(styrene-co-acrylonitrile), poly(caprolactone), or mixtures or blends thereof as long as the $T_g$ feature is met. Particularly useful resins for this layer are polyesters such as aliphatic polyesters including but not limited to, polylactic acid; blends of polylactic acid with polybutylene succinate, polyhydroxyalkanoates, or aliphatic-aromatic copolyesters; or alicylic polyesters as described in U.S. Pat. No. 5,387,571 (Daly) or blends of these polyesters.

Other useful polyester resins are described in U.S. Pat. No. 6,897,183 (Arrington et al.) and U.S. Pat. No. 7,125,611 (Kung et al.) that are incorporated herein by reference. These polyester resins include both aliphatic and aromatic portions derived from various dibasic acids in reaction with a diol. Most useful polyesters for this invention comprise: (a) recurring dibasic acid derived units and diol derived units, at least 50 mole % of the dibasic acid derived units comprising dicarboxylic acid derived units containing an alicyclic ring comprising 4 to 10 ring carbon atoms, which ring is within two carbon atoms of each carboxyl group of the corresponding dicarboxylic acid; (b) 25 to 75 mole % of the diol derived units containing an aromatic ring not immediately adjacent to each hydroxyl group of the corresponding diol or an alicyclic ring; and (c) 25 to 75 mole % of the diol derived units of the polyester contain an alicyclic ring comprising 4 to 10 ring carbon atoms.

While other resins and addenda are optionally present, one advantage of this invention is that the extruded, non-crosslinked image receiving layer is relatively "simple" in construction and composition. That is, in most embodiments, it consists essentially of the noted non-crosslinked resins, such as non-crosslinked polyesters that have the noted $T_g$. The non-crosslinked resin can remain in the extruder at a lower temperature or without drool during gaps in manufacturing runs thus minimizing waste. Even if the non-crosslinked image receiving layer by itself can not be printed directly (due to sticking), printing can be carried out in conjunction with the aqueous coated topcoat disposed over the image receiving layer, according to the present invention.

The image receiver layer generally can be extruded at a thickness of at least 100 μm and typically from about 100 μm to about 800 μm, and then uniaxially stretched to less than 10 μm. The final dry thickness of the image receiving layer is generally from about 1 μm to about 10 μm, and typically from about 1 μm to about 5 μm with the optimal thickness being determined for the intended purpose. The dry coverage for example can be from about 0.5 to about 20 g/m$^2$ or typically from about 1 to about 15 g/m$^2$.

It can be sometimes desirable for the image receiving layer (such as a thermal dye image receiving layer) to also comprise other additives such as lubricants that can enable improved conveyance through a printer. An example of a lubricant is a polydimethylsiloxane-containing copolymer such as a polycarbonate random terpolymer of bisphenol A, diethylene glycol, and polydimethylsiloxane block unit or ultrahigh molecular weight polydimethylsiloxane that can be present in an amount of from 10% to 30% by weight of the image receiving layer. Other additives that can be present are plasticizers such as esters or polyesters formed from a mixture of 1,3-butylene glycol adipate and dioctyl sebacate. The plasticizer would typically be present in an amount of from about 3% to about 20% by total weight of the image receiving layer.

Aqueous-Coated Topcoat

The essential topcoat used in this invention is applied directly to the extruded image receiving layer out of an aqueous formulation in the most desired embodiment. Thus, it is "aqueous-coated" as opposed to organic solvent-coated or extruded. Although there are no intermediate layers between the topcoat and the image receiving layer in the most desired embodiments, other layer(s) can be interspersed to achieve any function. It is desired to remove as much of the coating solvents as possible through drying techniques.

The topcoat comprises at least one polymer that has a $T_g$, as measured using a thermal analysis technique, that is generally within a range of plus or minus (±) 20° C., or within a range of plus or minus (±) 10° C., or more likely within a range of plus or minus (±) 5° C. of the $T_g$ of the image receiving layer. For purposes of identification in this section relating to the topcoat, this polymer is considered the "predominant" polymer and it constitutes at least 20 weight %, more likely at least 30 weight %, and in most embodiments, at least 50 weight %, of the dry weight of all polymers in the topcoat.

This "predominant" polymer in the topcoat can be a water soluble or water insoluble polymer that can be a dispersion or latex. Such polymers include but are not limited to, polymers and interpolymers prepared from ethylenically unsaturated monomers such as styrene, styrene derivatives, acrylic acid or methacrylic acid and their derivatives, olefins, chlorinated olefins, (meth)acrylonitriles, itaconic acid and its derivatives, maleic acid and its derivatives, vinyl halides, vinylidene halides, vinyl monomer having a primary amine addition salt, vinyl monomer containing an aminostyrene addition salt and others. Also included are polymers such as polyureas, polyurethanes, and polyesters, while polyesters, particularly polyester ionomers being most suited for their physical properties (such as high $T_g$), thermal dye-receiving capability and commercial availability in large quantity.

The term "polyester ionomer" refers to polyesters that contain at least one ionic moiety. Such ionic moieties function to make the polymer water dispersible. These polymers are substantially amorphous in nature. The $T_g$ of the polymer also plays an important role in its use in the thermal receiver element. Although lower $T_g$ materials are desired for higher dye transfer efficiency, too low a $T_g$ can cause material keeping artifacts like undesirable dye bleed, difficulty in materials handling like blocking of rolls, and other physical deficiencies. It is desired that the $T_g$ of these polyester ionomers be from about 0° C. to 100° C., typically from about 20° C. to 80° C. and more typically from about 25° C. to 60° C. The substantially amorphous polyester ionomers comprise dicarboxylic acid recurring units typically derived from dicarboxylic acids or their functional equivalents and diol recurring units typically derived from diols. Generally, such polyesters are prepared by reacting one or more diols with one or more dicarboxylic acids or their functional equivalents (for example, anhydrides, diesters, or diacid halides). Such diols, dicarboxylic acids, and their functional equivalents are sometimes referred to in the art as polymer precursors. It should be noted that, as known in the art, carbonylimino groups can be used as linking groups rather than carbonyloxy groups. This modification is readily achieved by reacting one or more diamines or amino alcohols with one or more dicarboxylic acids or their functional equivalents. Mixtures of diols and diamines can be used if desired.

Conditions for preparing the polyester ionomers are known in the art. The polymer precursors are condensed in a ratio of at least 1 mole of diol for each mole of dicarboxylic acid in the presence of a suitable catalyst at a temperature of from about 125° C. to about 300° C. Condensation pressure is typically from about 0.1 mm Hg to about one or more atmospheres. Low-molecular weight by-products are removed during condensation, for example by distillation or another suitable technique. The resulting condensation polymer is polycondensed under appropriate conditions to form a polyester resin. Polycondensation is usually carried out at a temperature of from about 150° C. to about 300° C. and a pressure very near vacuum, although higher pressures can be used.

The ionic moieties in these polyester ionomers can be provided by either ionic diol recurring units or ionic dicarboxylic acid recurring units, but usually by the latter. Such ionic moieties can be anionic or cationic in nature. Other exemplary ionic groups include sulfonic acid, quaternary ammonium, and disulfonylimino, and their salts and others known to a worker of ordinary skill in the art. In some embodiments, the polyester ionomers comprise from about 2 to about 25 mole percent, based on total moles of dicarboxylic acid recurring units, of ionic dicarboxylic acid recurring units.

Ionic dicarboxylic acids found to be particularly useful are those having units represented by the formula:

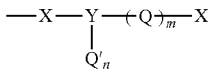

wherein each of m and n is 0 or 1 and the sum of m and n is 1; each X is carbonyl;

Q has the formula:

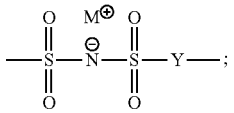

Q' has the formula:

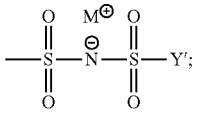

Y is a divalent aromatic radical, such as arylene (for example, phenylene, naphthalene, and xylylene) or arylidyne (for example, phenenyl and naphthylidyne); Y' is a monovalent aromatic radical, such as aryl, aralkyl or alkaryl (for example phenyl, p-methylphenyl, and naphthyl), or alkyl having from 1 to 12 carbon atoms, such as methyl, ethyl, isopropyl, n-pentyl, neopentyl, and 2-chlorohexyl, and typically from 1 to 6 carbon atoms; and M is a solubilizing cation such as a monovalent cation such as an alkali metal or ammonium cation.

Exemplary dicarboxylic acids and functional equivalents from which such ionic recurring units are derived are 3,3'-[(sodioimino)disulfonyl]dibenzoic acid; 3,3'-[(potassioimino)disulfonyl]dibenzoic acid, 3,3'-[(lithioimino)disulfonyl]dibenzoic acid; 4,4'-[(lithioimino)disulfonyl]dibenzoic acid; 4,4'-[(sodioimino)disulfonyl]dibenzoic acid; 4,4'-[(potassioimino)disulfonyl]dibenzoic acid; 3,4'-[(lithioimino)disulfonyl]dibenzoic acid; 3,4'-[(sodioimino)disulfonyl]dibenzoic acid; 5-[4-chloronaphth-1-ylsulfonyl(sodioimino)sulfonyl]isophthalic acid; 4,4'-[(potassioimino)disulfonyl]dinaphthoic acid; 5-[p-tolylsulfonyl(potassioimino)sulfonyl]isophthalic acid; 4-[p-tolylsulfonyl(sodioimino)sulfonyl]-1,5-naphthalenedicarboxylic acid; 5-[n-hexylsulfonyl(lithioimino)sulfonyl]isophthalic acid; 2-[phenylsulfonyl(potassioimino)sulfonyl]terephthalic acid and functional equivalents thereof. These and other dicarboxylic acids useful in forming preferred ionic recurring units are described in U.S. Pat. No. 3,546,180 (Caldwell et al.) the disclosure of which is incorporated herein by reference. Ionic dicarboxylic acid recurring units can also be derived from 5-sodiosulfobenzene-1,3-dicarboxylic acid, 5-sodiosulfocyclohexane-1,3-dicarboxylic acid, 5-(4-sodiosulfophenoxy)benzene-1,3-dicarboxylic acid, 5-(4-sodiosulfophenoxy)cyclohexane-1,3-dicarboxylic acid, similar compounds and functional equivalents thereof and others described in U.K. Patent Publication 1,470,059.

Ionic dicarboxylic acid recurring units can also be derived from 5-sodiosulfobenzene-1,3-dicarboxylic acid, 5-sodiosulfocyclohexane-1,3-dicarboxylic acid, 5-(4-sodiosulfophenoxy)benzene-1,3-dicarboxylic acid, 5-(4-sodiosulfophenoxy)cyclohexane-1,3-dicarboxylic acid, similar compounds and functional equivalents thereof and others described in U.K. Patent Specification No. 1,470,059 (noted above).

The amorphous polyester ionomers generally comprise from about 75 to about 98 mole %, based on total moles of dicarboxylic acid recurring units, of dicarboxylic acid recurring units which are nonionic in nature. Such nonionic units can be derived from any suitable dicarboxylic acid or functional equivalent which will condense with a diol as long as the resulting polyester is substantially amorphous. Such units have the formula:

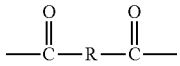

wherein R is saturated or unsaturated divalent hydrocarbon. For example, R is alkylene of 2 to 20 carbon atoms, (for example, ethylene, propylene, neopentylene, and 2-chlorobutylene); cycloalkylene of 5 to 10 carbon atoms, (for example, cyclopentylene, 1,3-cyclohexylene, 1,4-cyclohexylene, and 1,4-dimethylcyclohexylene); or arylene of 6 to 12 carbon atoms, (for example, phenylene and xylylene). Such recurring units are derived from, for example, phthalic acid, isophthalic acid, terephthalic acid, malonic acid, succinic acid, glutaric acid, adipic acid, suberic acid, and 1,3-cyclohexane dicarboxylic acid and functional equivalents thereof.

The dicarboxylic acid recurring units are linked in a polyester by recurring units derived from difunctional compounds capable of condensing with a dicarboxylic acid or a functional equivalent thereof. Such difunctional compounds include diols of the formula HO—$R_1$—OH wherein $R_1$ is a divalent aliphatic, alicyclic or aromatic radical of from 2 to 12 carbon atoms and includes hydrogen and carbon atoms and optionally, ether oxygen atoms. Such aliphatic, alicyclic, and aromatic radicals include alkylene, cycloalkylene, arylene, alkylenearylene, alkylenecycloalkylene, alkylenebisarylene, cycloalkylenebisalkylene, arylenebisalkylene, alkylene-oxy-alkylene, alkylene-oxy-arylene-oxy-alkylene, arylene-oxy-alkylene, and alkylene-oxy-cycloalkylene-oxy-alkylene.

Exemplary diols include ethylene glycol, diethylene glycol, triethylene glycol, 1,3-propanediol, 1,4-butanediol, 2-methyl-1,5-pentanediol, neopentyl glycol, 1,4-cyclohexanedimethanol, 1,4-bis(β-hydroxyethoxy) cyclohexane, quinitol, norcamphanediols, 2,2,4,4-tetraalkylcyclobutane-1,3-diols, p-xylene diol, and Bisphenol A.

In one embodiment, the substantially amorphous polyesters described herein comprise diol recurring units of either of the formulae

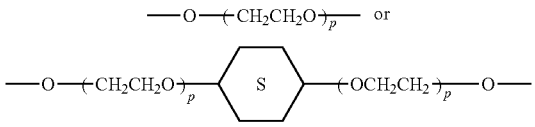

wherein p is an integer from 1 to 4. Such recurring units are present in the polyesters in an amount of at least 50 mole percent, and typically from about 50 to 100 mole percent, based on total moles of diol recurring units. Amorphous polyester ionomers useful in the practice of this invention include poly[1,4-cyclohexylenedi(oxyethylene) 3,3'-[(sodioimino) disulfonyl]dibenzoate-co-succinate (5:95 molar ratio)], poly [1,4-cyclohexylenedi(oxy-ethylene)-co-ethylene (75:25 molar ratio) 3,3'-[(potassioimino)disulfonyl]dibenzoate-co-azelate (10:90 molar ratio)], poly[1,4-cyclohexylene-di(oxy-ethylene)3,3'-[(sodioimino)disulfonyl]-dibenzoate-co-adipate (95:5 molar ratio)], and poly[1,4-cyclohexylenedi (oxyethylene)3,3'-[(sodioimino)-disulfonyl]dibenzoate-co-3,3'-(1,4-phenylene)-dipropionate (20:80 molar ratio)].

Commercially available aqueous dispersible polyester ionomers suitable for this invention include Eastman AQ® polyester ionomers that are manufactured by Eastman Chemical Co. These polymers are described in Eastman chemical literature Publication CB-41A (December 2005), incorporated herein by reference.

The aforesaid polyester can comprise 1 to 99% of the total dry weight of the topcoat. However, it is intended that the polyester comprises from 20 to 95%, or from 30 to 90%, or from 50 to 90% of the total dry weight of the topcoat.

It is also desired that the aqueous-coated topcoat includes one or more crosslinking agents for the aforesaid polyester. Representative crosslinking agents include but are not limited to, organic compounds including but not limited to, melamine formaldehyde resins, glycoluril formaldehyde resins, polycarboxylic acids and anhydrides, polyamines, polyaziridines, epoxides, carbodiimides, epihalohydrins, diepoxides, dialdehydes, diols, carboxylic acid halide, ketenes, and combinations thereof. The best crosslinking agents are soluble or dispersible in water or water/alcohol mixtures. These compounds can be obtained from a number of commercial sources or prepared using known chemistry. A variety of suitable melamine formaldehyde and glycocuril formaldehyde crosslinking agents are available from Cytec Industries under the trademark Cymel® resins. Useful epihalohydrins included polyamide-epichlorohydrin crosslinking agents including those available from Hercules Inc. under the trademark POLYCUP® resins.

The crosslinking agents are generally present in an amount of from about 0.01 to about 50 weight %, or typically from about 1 to about 20 weight %, based on total layer dry weight.

In addition to the noted polyester material, the aqueous topcoat can comprise other polymers. In this regard, a water-dispersible polymer (latex) having a polyurea or polyurethane backbone is preferred. Such polymers can comprise 1 to 99% of the total dry weight of the topcoat. However, it is intended that such polymers comprise from 1 to 49%, or from 2 to 30%, or from 5 to 25% of the total dry weight of the topcoat.

Conventional processes for making polyurethane dispersions involve the steps of preparing a prepolymer having a relatively low molecular weight and small excess of isocyanate groups and chain-extending during the dispersion process. Besides the raw materials, the polyurethane dispersions sold by various manufactures differ in the process used to prepare the prepolymers (for example, a solvent-free polymer process, Ketimine and Ketazine process, Hybrid systems, and Ethyl Acetate process) and the type of chain extender used in the dispersion step. Such materials and processes have been disclosed in, for example, U.S. Pat. No. 4,335,029 (Dadi et al.), in "Aqueous Polyurethane Dispersions" by B. K. Kim, Colloid & Polymer Science, Vol. 274, No. 7 (1996) 599-611 Steinopff Verlag 1996, and in "Polyurethane Dispersion Process" by Manea et al. Paint and Coating Industry, January 2000, page 30.

The polyurethane useful for the practice of this invention is generally prepared without involving the chain-extension step during the dispersion step. It is desired to have the chemical reaction for forming the urethane or urea linkages prior to the dispersion step. This will insure that the polyurethane dispersion used will have well-controlled molecular weight and molecular weight distribution and be free of gel particles.

In one of the processes, the polyurethane useful for the present invention is prepared in a water miscible organic solvent such as tetrahydrofuran, followed by neutralizing the hydrophilic groups, for example carboxylic acid groups, with an organic base, for example triethylamine. The polyurethane solution is then diluted with doubly distilled de-ion water. The water miscible organic solvent is removed by distillation to form a stable polyurethane dispersion. The polyurethane particles are formed by precipitation during the solvent evaporation.

In a second useful process, the polyurethane useful for the invention is prepared in a water-immiscible organic solvent such as ethyl acetate. The polyurethane is then neutralized with an organic base and water is added to form an aqueous dispersion comprising primarily minute drops of polyurethane-water-immiscible organic solvent solution suspended in water. The water-immiscible organic solvent is then removed to form the desired polyurethane dispersion.

Polyureas are generally prepared by reacting an amine terminated diamine or polyamine compound with a diisocyanate or a polyfunctional isocyanate in the presence of a suitable catalyst and optional additives.

Polyurethanes are generally prepared by reacting a polyol with a diisocyanate or a polymer isocyanate in the presence of suitable catalysts and additives. These reactions are well known in the art and generally utilize various polymerization catalysts. Thus, polyurea or polyurethane backbones are formed.

In order to prevent donor-receiver sticking or welding, it is desirable to incorporate polysiloxane side chains that are covalently attached to the backbone of the polyurethane or polyurea polymer. Up to 25 weight % but typically from about 5 to about 20 weight % of the polyurethane or polyurea polymer can comprise the polysiloxane side chain. Each of these side chains can have a molecular weight of at least 500 and typically from about 500 to about 10,000.

The desired polysiloxane side chains can be incorporated by various techniques. In some embodiments, the siloxane units are attached to unreacted isocyanate functional groups in the backbone by reaction of a hydroxyl functional group in the siloxane in the presence of a suitable catalyst.

In other embodiments, the polysiloxane side chains are derived from a siloxane-containing diol or diamine can be represented by the following Structure (SX-1) that is reacted with an appropriate polyisocyanate:

(SX-1)

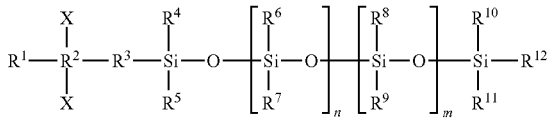

wherein $R^1$ through $R^{12}$ are independently substituted or unsubstituted alkyl or substituted or unsubstituted aryl groups, and n and m are independently 0 to 500 such that the sum of n and m is from 10 to 500.

The polyurea or polyurethane polymers can be optionally cross-linked using suitable crosslinking agents such as those comprising aziridine, carbodiimide, epoxides and the like and/or any other crosslinking agent known in the art.

The aqueous-coated topcoat can include other optional components including but not limited to antistatic agents (described below), various non-polyurea and non-polyurethane copolymers (such as polyesters, polycarbonates, polycyclohexylenedimethylene terephthalate, and vinyl modified polyester copolymers) as described for example in U.S. Pat. No. 7,189,676 (Bourdelais et al.), plasticizers such as monomeric and polymeric esters as described for example in Col. 4 of U.S. Pat. No. 7,514,028 (Kung et al.), UV absorbers, release agents, surfactants, defoamers, coating aids, charge control agents, thickeners or viscosity modifiers, antiblocking agents, coalescing aids, other crosslinking agents or hardeners, soluble or solid particle dyes, matte beads, inorganic or polymeric particles, adhesion promoting agents, bite solvents or chemical etchants, lubricants such as wax, siloxane and fluoropolymers, antioxidants, stabilizers, colorants or tints, fillers and other addenda that are well-known in the art.

Useful antistatic agents include both organic and inorganic compounds that are electrically-conductive that can be either ionic conductors or electronic conductors. They can include simple inorganic salts, alkali metal salts or surfactants, charge control agents, ionic conductive polymers, electronically conductive polymers, polymeric electrolytes containing alkali metal salts, synthetic or natural clays such as phyllosilicates particularly smectite clays, colloidal metal oxide sols and mixed metal oxide sols, conductive carbon including single-wall or multi-wall carbon nanotubes or graphene, and other useful compounds known in the art. These compounds can be incorporated into the aqueous-coated topcoat in appropriate amounts for a desired conductivity. Among the noted antistatic agents, charge control agents such as non-ionic or ionic surfactants, conductive salts, colloidal metal oxides such as semiconducting tin oxide, mixed metal oxides such as semiconducting zinc antimonate or indium tin oxide, ionic conductive polymers such as polystyrene sulfonic acid or its salts, electronically conductive polymers such as polythiophene, polyaniline, or polypyrrole, and carbon nanotubes are particularly useful in these embodiments because of their effectiveness, transparency, or commercial availability.

The aqueous coated topcoat can be of any dry coverage from 1 mg/m$^2$ to 10,000 mg/m$^2$. However, an aqueous coated topcoat that is too high in coverage can be difficult to dry under typical manufacturing and drying conditions. On the other hand, a topcoat with very low coverage can be non-uniform and discontinuous and can render the imaging element inferior. For optimum characteristics the topcoat is present at a dry coverage of between 10 mg/m$^2$ to 5000 mg/m$^2$, or between 100 mg/m$^2$ and 2000 mg/m$^2$, and particularly between 150 mg/m$^2$ and 1500 mg/m$^2$. In terms of thickness, the topcoat is generally from about 0.01 μm to about 5 μm, or from about 0.1 μm to about 2 μm, or even from about 0.15 μm to about 1.5 μm.

An important parameter in the practice of this invention is the dry thickness ratio of the topcoat to the extruded image receiving layer. The topcoat is considerably thinner. For example, the dry thickness ratio of the topcoat to the extruded image receiving layer is from 1:1 to 1:100. More particular, this dry thickness ratio is from about 1:2 to about 1:75.

Because of the specific compositional and functional features of the topcoat and image receiving layer and the dry thickness ratio described herein, it has been discovered that the partitioning of the dye between the image receiving layer and the topcoat can be adjusted so as to enable printing while satisfying image stability criteria.

Optional Antistatic Layer

The presence of an intermediate layer between the extruded compliant and extruded image receiving layers is not preferred, but in the event an antistatic layer is present, it can be an extruded or aqueous-coated layer. In most instances, the intermediate layer is an aqueous-coated antistatic layer (or subbing layer) that comprises polymeric materials that provide excellent adhesion to the extruded compliant layer (and skin layer if present) as well as the extruded image receiving layer. Typically, the antistatic layer comprises a film-forming polymer that can be one or more of a water soluble polymer, a hydrophilic colloid, or a water insoluble polymer latex or dispersion. However, it is generally humidity insensitive, in order to ensure invariant performance under a wide range of humidity conditions at users end. In this regard, the film-forming polymer(s) in the layer, upon drying, absorbs less than 10%, typically less than 5% or less than 2%, or even less than 1% of its weight of moisture under 80% RH at 23° C.

Useful polymers include polymers and interpolymers prepared from ethylenically unsaturated monomers such as styrene, styrene derivatives, acrylic acid or methacrylic acid and their derivatives, olefins, chlorinated olefins, (meth)acrylonitriles, itaconic acid and its derivatives, maleic acid and its derivatives, vinyl halides, vinylidene halides, vinyl monomer having a primary amine addition salt, vinyl monomer containing an aminostyrene addition salt and others. Also useful are polyurethanes and polyesters. The $T_g$ of the binder polymer is generally below 45° C., typically below 40° C., or below 25° C. and ideally at or below 15° C., in order to ensure sufficient flow during thermal extrusion of the dye receiving layer over the antistatic subbing layer, and thus provide desired adhesion. The binder polymer can be semi-crystalline or amorphous. Useful binder polymers are disclosed for example in U.S. Pat. Nos. 6,171,769; 6,120,979; and 6,077,656; 6,811,724; and 6,835,516, and U.S. Patent Application Publication 2008/0220190, all incorporated herein by reference, because of their excellent adhesion characteristics.

In order to provide appropriate static protection to the imaging element during its manufacturing, finishing, and end use, the aqueous-coated subbing layer can be an "antistatic layer" and also contain one or more antistatic agents as described above.

The aqueous-coated subbing layer can comprise any number of addenda for any specific reason such as tooth-providing ingredients (as described in U.S. Pat. No. 5,405,907, incorporated herein by reference), surfactants, defoamers or coating aids, charge control agents, thickeners or viscosity modifiers, coalescing aids, crosslinking agents or hardeners, soluble and/or solid particle dyes, antifoggants, fillers, matte beads, inorganic or polymeric particles, adhesion promoting agents, bite solvents or chemical etchants, lubricants, plasticizers, antioxidants, voiding agents, colorants or tints, roughening agents, slip agent, UV absorbers, and other addenda known in the art.

The aqueous-coated antistatic layer can be of any coverage (thickness). The dry coverage is generally between 100 mg/m$^2$ and 2000 mg/m$^2$ and typically between 150 mg/m$^2$ and 600 mg/m$^2$. The final thickness of the aqueous-coated subbing layer is generally from about 0.1 μm to about 2 μm and typically from about 0.3 μm to about 0.6 μm.

Preparation of Various Layers in Element

According to some embodiments of the invention, a skin layer can be formed on either side of the extruded compliant layer or on both sides of the extruded compliant layer. These skin layers can be individually extruded onto the support described below by any of the extrusion methods like extrusion coating or cast extrusion or hot melt extrusion. In these methods, the polymer or resin blend is melted in the first step. In a second step, the melt is homogenized to reduce temperature excursions or adjusted and delivered to the die. In a third step, the skin layers are delivered onto a support or a modified support and rapidly quenched below their transition temperature (melting point or glass transition) so as to attain rigidity. For the skin layer closer to the support, the resin is delivered onto the support while the skin layer closer to the image receiving layer is delivered onto the compliant layer that has been coated on a support (this is known as modified support).

Instead of laying down the skin layer(s) individually that requires multiple stations or multiple operations, a useful method of laying down the skin layer(s) simultaneously with the compliant layer. This is typically known as multilayer co-extrusion. In this method, two or more polymers or resin formulations are extruded and joined together in a feedblock or die to form a single structure with multiple layers. Typically, two basic die types are used for co-extrusion: multi-manifold dies and feedblock with a single manifold die although hybrid versions exist that combine feedblocks with multi-manifold dies. In the case of a multi-manifold die, the die has individual manifolds that extend its full width. Each of the manifolds distributes the polymer layer uniformly. The combination of the layers (in this case skin(s) with compliant layer) might occur inside the die before the final die land or outside the die. In the case of the feedblock method, the feedblock arranges the melt stream in the desired layer structure prior to the die inlet. A modular feedblock design along with the extruder flow rates enables the control of sequence and thickness distribution of the layers.

Overall in a first step for creating the skin layer(s), the polymer or resin blend composition is melted and delivered to the co-extrusion configuration. Similarly for the compliant layer, the resin blend composition is melted and delivered to the co-extrusion configuration. To enable good spreading and layer uniformity, the skin layer viscosity characteristics should not be more than 10 times or 1:10, or not more than 3 times or less than 1:3 difference in viscosity from that of the melt that forms the compliant layer. This promotes efficient and high quality coextrusion and avoids nonuniform layers. Layer uniformity can be adjusted by varying melt temperature. To enable good interlayer adhesion, material composition can be optimized, layer thickness can be varied, and also the melt temperature of the streams adjusted in the coextrusion configuration.

In a third step of creating a coextruded structure of skin layer(s) with a compliant layer, the coextruded layers or laminate can be stretched or oriented to reduce the thickness. In a fourth step, the extruded and stretched laminate is applied to the support described below while simultaneously reducing the temperature within the range below the melting temperature ($T_m$) or glass transition temperature ($T_g$) of the skin layer(s), for example, by quenching between two nip rollers that can have the same or different finish such as matte, rough glossy, or mirror finish.

In addition, the skin layers can be extruded separately (as noted above), or co-extruded with one or more of the other layers.

The image receiving layer is extruded onto the extruded compliant layer (or topmost skin layer) using similar technology and this layer can be co-extruded with the other extruded layers. The topcoat can be applied onto the extruded image receiving layer as an aqueous formulation (see Examples below).

Element Structure and Supports

The particular structure of an imaging element (for example, a thermal dye receiver element) of the present invention can vary, but it is generally a multilayer structure comprising, under the topcoat, an extruded image receiving layer, optional antistatic or subbing layer, extruded compliant layer, and a substrate (defined as all layers below the extruded compliant layer) that comprises a base support, such as a cellulose paper comprising cellulose paper fibers, a synthetic paper comprising synthetic polymer fibers, or a resin coated paper. But other base supports such as fabrics and polymer sheets can be used. The base support can be any support typically used in imaging applications. Any of the image receiving elements of this invention could further be laminated to a substrate or support to increase the utility of the element.

The resins used on the bottom or wire side (backside) of the paper base are thermoplastics like polyolefins such as polyethylene, polypropylene, copolymers of these resins, or blends of these resins. The thickness of the resin layer on the bottom side of the raw base can range from about 5 μm to about 75 μm and typically from about 10 μm to about 40 μm. The thickness and resin composition of the resin layer can be adjusted to provide desired curl characteristics. The surface roughness of this resin layer can be adjusted to provide desired conveyance properties in imaging printers.

The base support can be transparent or opaque, reflective or non-reflective. Opaque supports include plain paper, coated paper, resin-coated paper such as polyolefin-coated paper, synthetic paper, low density foam core based support, and low density foam core based paper, photographic paper support, melt-extrusion-coated paper, and polyolefin-laminated paper.

The papers include a broad range of papers, from high end papers, such as photographic paper to low end papers, such as newsprint. In one embodiment, Ektacolor® paper made by Eastman Kodak Co. as described in U.S. Pat. Nos. 5,288,690 and 5,250,496, both incorporated herein by reference, can be employed. The paper can be made on a standard continuous fourdrinier wire machine or on other modern paper formers. Any pulps known in the art to provide paper can be used. Bleached hardwood chemical kraft pulp is useful as it provides brightness, a smooth starting surface, and good formation while maintaining strength. Papers useful in this invention are of caliper from about 50 μm to about 230 μm typically from about 100 μm to about 190 μm, because then the overall imaged element thickness is in the range desired by customers and for processing in existing equipment. They can be "smooth" so as to not interfere with the viewing of images. Chemical additives to impart hydrophobicity (sizing), wet strength, and dry strength can be used as needed. Inorganic filler materials such as $TiO_2$, talc, mica, $BaSO_4$ and $CaCO_3$ clays can be used to enhance optical properties and reduce cost as needed. Dyes, biocides, and processing chemicals can also be used as needed. The paper can also be subject to smoothing operations such as dry or wet calendering, as well as to coating through an in-line or an off-line paper coater.

A particularly useful support is a paper base that is coated with a resin on either side. Biaxially oriented base supports include a paper base and a biaxially oriented polyolefin sheet, typically polypropylene, laminated to one or both sides of the paper base. Commercially available oriented and unoriented polymer films, such as opaque biaxially oriented polypropylene or polyester, can also be used. Such supports can contain pigments, air voids or foam voids to enhance their opacity. The base support can also consist of microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861 that is incorporated herein by reference. Microvoided composite biaxially oriented sheets can be utilized and are conveniently manufactured by coextrusion of the core and surface layers, followed by biaxial orientation, whereby voids are formed around void-initiating material contained in the core layer. Such composite sheets are disclosed in, for example, U.S. Pat. Nos. 4,377,616, 4,758,462, and 4,632,869, the disclosures of which are incorporated by reference.

"Void" is used herein to mean devoid of added solid and liquid matter, although it is likely the "voids" contain gas. The void-initiating particles, which remain in the finished packaging sheet core, should be from about 0.1 μm to about 10 μm in diameter and typically round in shape to produce voids of the desired shape and size. The size of the void is also dependent on the degree of orientation in the machine and transverse directions. Ideally, the void would assume a shape that is defined by two opposed, and edge contacting, concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

Biaxially oriented sheets, while described as having at least one layer, can also be provided with additional layers that can serve to change the properties of the biaxially oriented sheet. Such layers might contain tints, antistatic or conductive materials, or slip agents to produce sheets of unique properties. Biaxially oriented sheets can be formed with surface layers, referred to herein as skin layers, which would provide an improved adhesion, or look to the support and photographic element. The biaxially oriented extrusion can be carried out with as many as 10 layers if desired to achieve some particular desired property. The biaxially oriented sheet can be made with layers of the same polymeric material, or it can be made with layers of different polymeric composition. For compatibility, an auxiliary layer can be used to promote adhesion of multiple layers.

Transparent supports include glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The term as used herein, "transparent" means the ability to pass visible radiation without significant deviation or absorption.

The base support used in the invention can have a thickness of from about 50 μm to about 500 μm or typically from about 75 μm to about 350 μm. Antioxidants, brightening agents, antistatic or conductive agents, plasticizers and other known additives can be incorporated into the support, if desired. In one embodiment, the element has an L*UVO (UV out) of greater than 80 and a b*UVO of from 0 to −6.0. L*, a* and b* are CIE parameters (see, for example, Appendix A in Digital Color Management by Giorgianni and Madden, published by Addison, Wesley, Longman Inc., 1997) that can be measured using a Hunter Spectrophotometer using the D65 procedure. "UV out" (UVO) refers to use of UV filter during characterization such that there is no effect of UV light excitation of the sample.

In another embodiment, the base support comprises a synthetic paper that is typically cellulose-free, having a polymer core that has adhered thereto at least one flange layer. The polymer core comprises a homopolymer such as a polyolefin, polystyrene, polyester, polyvinylchloride, or other typical thermoplastic polymers; their copolymers or their blends thereof; or other polymeric systems like polyurethanes and polyisocyanurates. These materials may or may not have been expanded either through stretching resulting in voids or through the use of a blowing agent to consist of two phases, a solid polymer matrix, and a gaseous phase. Other solid phases can be present in the form of fillers that are of organic (polymeric, fibrous) or inorganic (glass, ceramic, metal) origin. The fillers can be used for physical, optical (lightness, whiteness, and opacity), chemical, or processing property enhancements of the core.

In still another embodiment, the base support comprises a synthetic paper that can be cellulose-free, having a foamed polymer core or a foamed polymer core that has adhered thereto at least one flange layer. The polymers described for use in a polymer core can also be employed in manufacture of the foamed polymer core layer, carried out through several mechanical, chemical, or physical means. Mechanical methods include whipping a gas into a polymer melt, solution, or suspension, which then hardens either by catalytic action or heat or both, thus entrapping the gas bubbles in the matrix. Chemical methods include such techniques as the thermal decomposition of chemical blowing agents generating gases such as nitrogen or carbon dioxide by the application of heat or through exothermic heat of reaction during polymerization. Physical methods include such techniques as the expansion of a gas dissolved in a polymer mass upon reduction of system pressure; the volatilization of low-boiling liquids such as fluorocarbons or methylene chloride, or the incorporation of hollow microspheres in a polymer matrix. The choice of foaming technique is dictated by desired foam density reduction, desired properties, and manufacturing process. The foamed polymer core can comprise a polymer expanded through the use of a blowing agent.

In a many embodiments, polyolefins such as polyethylene and polypropylene, their blends and their copolymers are used as the matrix polymer in the foamed polymer core along with a chemical blowing agent such as sodium bicarbonate and its mixture with citric acid, organic acid salts, azodicarbonamide, azobisformamide, azobisisobutyrolnitrile, diazoaminobenzene, 4,4'-oxybis(benzene sulfonyl hydrazide) (OBSH), N,N'-dinitrosopentamethyl-tetramine (DNPA), sodium borohydride, and other blowing agent agents well known in the art. Useful chemical blowing agents would be sodium bicarbonate/citric acid mixtures, azodicarbonamide; though others can also be used. These foaming agents can be used together with an auxiliary foaming agent, nucleating agent, and a cross-linking agent.

One embodiment of the invention is a thermal dye transfer receiver element for thermal dye transfer comprising a base support and the layers described above in which the image receiving layer is a thermal dye transfer receiving layer.

In some embodiments, the image receiving elements are "dual-sided", meaning that they have an extruded image receiving layer (such as a thermal dye transfer image receiving layer) and an aqueous-coated topcoat on both sides of the support. Each side can also include an extruded compliant layer.

Dye Donors Elements

Ink or thermal dye-donor elements that can be used with the image receiving element of this invention generally comprise a support having thereon an ink or dye containing layer.

Any ink or dye can be used in the thermal ink or dye-donor provided that it is transferable to the thermal ink or thermal dye transfer receiving or recording layer by the action of heat. Ink or dye donor elements are described, for example, in U.S. Pat. Nos. 4,916,112; 4,927,803; and 5,023,228 that are all incorporated herein by reference. As noted above, ink or dye-donor elements can be used to form an ink or dye transfer image. Such a process comprises image-wise-heating an ink or dye-donor element and transferring an ink or dye image to an ink or image receiving or recording element as described above to form the ink or dye transfer image. In the thermal ink or dye transfer method of printing, an ink or dye donor element can be employed that comprises a poly(ethylene terephthalate) support coated with sequential repeating areas of cyan, magenta, or yellow ink or dye, and the ink or dye transfer steps can be sequentially performed for each color to obtain a multi-color ink or dye transfer image. The support can include a black ink. The support can also include a clear protective layer that can be transferred onto the transferred dye images. When the process is performed using only a single color, then a monochrome ink or dye transfer image can be obtained.

Dye-donor elements can comprise a support having thereon a dye containing layer. Any dye can be used in the dye layer of the dye-donor element provided it is transferable to the image receiving layer by the action of heat. Especially good results have been obtained with diffusible dyes, such as the magenta dyes described in U.S. Pat. No. 7,160,664 (Goswami et al.) that is incorporated herein by reference.

The dye-donor layer can include a single color area (patch) or multiple colored areas (patches) containing dyes suitable for thermal printing. As used herein, a "dye" can be one or more dye, pigment, colorant, or a combination thereof, and can optionally be in a binder or carrier as known to practitioners in the art. For example, the dye layer can include a magenta dye combination and further comprise a yellow dye-donor patch comprising at least one bis-pyrazolone-methine dye and at least one other pyrazolone-methine dye, and a cyan dye-donor patch comprising at least one indoaniline cyan dye.

Any dye transferable by heat can be used in the dye-donor layer of the dye-donor element. The dye can be selected by taking into consideration hue, lightfastness, and solubility of the dye in the dye donor layer binder and the thermal dye transfer image receiving layer binder.

Further examples of useful dyes can be found in U.S. Pat. Nos. 4,541,830; 4,698,651; 4,695,287; 4,701,439; 4,757,046; 4,743,582; 4,769,360; 4,753,922; 4,910,187; 5,026,677; 5,101,035; 5,142,089; 5,374,601; 5,476,943; 5,532,202; 5,804,531; 6,265,345, 7,501,382 (Foster et al.), and U.S. Patent Application Publications 2003/0181331 and 2008/0254383 (Soejima et al.), the disclosures of which are hereby incorporated by reference.

The dyes can be employed singly or in combination to obtain a monochrome dye-donor layer or a black dye-donor layer. The dyes can be used in an amount of from about 0.05 $g/m^2$ to about 1 $g/m^2$ of coverage. According to various embodiments, the dyes can be hydrophobic.

Imaging and Assemblies

As noted above, dye-donor elements and image receiving elements can be used to form a dye transfer image. Such a process comprises imagewise-heating a thermal dye donor element and transferring a dye image to the image receiving element as described above to form the dye transfer image.

A thermal dye donor element can be employed which comprises a poly(ethylene terephthalate) support coated with sequential repeating areas of cyan, magenta and yellow dye, and the dye transfer steps are sequentially performed for each color to obtain a three-color dye transfer image. The dye donor element can also contain a colorless area that can be transferred to the image receiving element to provide a protective overcoat.

Thermal printing heads that can be used to transfer ink or dye from ink or dye-donor elements to an image receiver element are available commercially. There can be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal ink or dye transfer can be used, such as lasers as described in, for example, GB Publication 2,083,726A (3M Corp.) that is incorporated herein by reference.

In another embodiment, the imaging receiving element can be an electrophotographic imaging element. The electrographic and electrophotographic processes and their individual steps have been well described in the prior art, for example U.S. Pat. No. 2,297,691 (Carlson). The processes incorporate the basic steps of creating an electrostatic image, developing that image with charged colored particles (toner), optionally transferring the resulting developed image to a secondary substrate, and fixing the image to the substrate. There are numerous variations in these processes and basic steps such as the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor can be a single use system, or it can be rechargeable and reimageable, like those based on selenium or organic photoreceptors.

In an alternate electrographic process, electrostatic images are created ionographically. The latent image is created on dielectric (charge holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to an electrophotographic image receiving element. The image receiving element is charged electrostatically, with the polarity chosen to cause the toner particles to transfer to the receiving element. Finally, the toned image is fixed to the image receiving element. For self-fixing toners, residual liquid is removed from the image receiving element by air drying or heating. Upon evaporation of the solvent, these toners form a film bonded to the image receiving element. For heat-fusible toners, thermoplastic polymers are used as part of the particle. Heating both removes residual liquid and fixes the toner to image receiving element.

In another embodiment of this invention, the image receiver element can be used to receive a wax-based ink from an ink-jet printhead using what is known as a "phase change ink" that is transferred as described for example in U.S. Pat. No. 7,381,254 (Wu et al.), U.S. Pat. No. 7,541,406 (Banning et al.), and U.S. Pat. No. 7,501,015 (Odell et al.) that are incorporated herein by reference.

A thermal transfer assemblage can comprise (a) an ink or dye-donor element, and (b) an ink or thermal dye transfer image receiving element of this invention, the image receiving element being in a superposed relationship with the ink or dye donor element so that the ink or dye layer of the donor element can be in contact with the image receiving layer. Imaging can be obtained with this assembly using known processes.

When a three-color image is to be obtained, the above assemblage can be formed on three occasions during the time when heat can be applied by the thermal printing head. After the first dye is transferred, the elements can be peeled apart. A second dye donor element (or another area of the donor element with a different dye area) can be then brought in register with the thermal dye receiving layer and the process repeated. The third color can be obtained in the same manner.

The following embodiments and their combinations are representative of those included within the present invention:

1. An image receiving element comprising a substrate and having thereon an extruded compliant layer, an extruded image receiving layer, and a topcoat immediately adjacent the extruded image receiving layer, wherein:

the extruded image receiving layer is non-crosslinked and has a glass transition temperature ($T_g$) of from about 40° C. to about 80° C., the topcoat is an aqueous-coated layer and has a polymer that has a $T_g$ that is within a range of plus or minus 20° C. of the $T_g$ of the extruded image receiving layer, which polymer comprises at least 20 weight % of the total polymers in the topcoat, and the dry thickness ratio of the topcoat to the extruded image receiving layer is from 1:2 to 1:100.

2. The element of embodiment 1 wherein the topcoat comprises a crosslinked polyester.

3. The element of embodiment 1 or 2 wherein the topcoat comprises a polyurethane or a polyurea.

4. The element of embodiment 1 or 2 wherein the topcoat has a polymer that has a $T_g$ that is within a range of plus or minus 10° C. of the $T_g$ of the extruded image receiving layer, and the dry thickness ratio of the topcoat to the extruded image receiving layer is from 1:2 to 1:75.

5. The element of any of embodiments 1 to 4 wherein the topcoat comprises a crosslinked polyester and the extruded image receiving layer comprises a non-crosslinked aliphatic polyester that is an aliphatic polyester, aromatic-aliphatic polyester copolymers, or an alicyclic polyester.

6. The element of any of embodiments 1 to 5 wherein the extruded image receiving layer comprises a non-crosslinked aliphatic polyester that is a non-crosslinked aliphatic polyester or blend of an aliphatic polyester that is a polylactic acid, polybutylene succinate, or polyhydroxyalkanoates, aliphatic-aromatic copolyester, alicylic polyester, or a polyester comprising: (a) recurring dibasic acid derived units and diol derived units, at least 50 mole % of the dibasic acid derived units comprising dicarboxylic acid derived units containing an alicyclic ring comprising 4 to 10 ring carbon atoms, which ring is within two carbon atoms of each carboxyl group of the corresponding dicarboxylic acid, (b) 25 to 75 mole % of the diol derived units containing an aromatic ring not immediately adjacent to each hydroxyl group of the corresponding diol or an alicyclic ring, and (c) 25 to 75 mole % of the diol derived units of the polyester contain an alicyclic ring comprising 4 to 10 ring carbon atoms.

7. The element of any of embodiments 1 to 6 wherein the substrate comprises a raw paper base support.

8. The element of any of embodiments 1 to 6 wherein the substrates comprises a synthetic paper base.

9. The element of any of embodiments 1 to 8 wherein the extruded compliant layer comprises an elastomeric polymer that is present in an amount of from about 15 to about 50 weight %.

10. The element of embodiment 9 wherein the elastomeric polymer comprises a thermoplastic polyolefin blend, styrene/alkylene block copolymer, polyether block polyamide, copolyester elastomer, ethylene/propylene copolymer, or thermoplastic urethane, or a mixture thereof.

11. The element of embodiment 9 or 10 wherein the extruded compliant layer comprises from about 35 to about 80 weight % of a matrix polymer, from about 15 to about 40 weight % of the elastomeric polymer, and from about 2 to about 25 weight % of an amorphous or semi-crystalline polymer additive.

12. The element of any of embodiments 1 to 11 wherein the extruded compliant layer is a voided or foamed compliant layer.

13. The element of any of embodiments 1 to 12 further comprising an extruded skin layer immediately adjacent either or both sides of the extruded compliant layer.

14. The element of embodiment 13 wherein the extruded skin layer(s) and extruded compliant layer are co-extruded layers.

15. The element of any of embodiments 1 to 14 wherein the image receiving layer, extruded compliant layer, and optional extruded skin layer(s) are co-extruded on the support.

16. The element of any of embodiments 1 to 15 wherein the image receiving layer is a thermal dye transfer image receiving layer and the element is a thermal dye transfer receiver element.

17. The element of any of embodiments 1 to 16 wherein the image receiving layer consists essentially of a non-crosslinked aliphatic polyester.

18. An assembly comprising the imaging element of any of embodiments 1 to 17 and an image donor element.

19. The assembly of embodiment 18 wherein the imaging element is a thermal dye transfer receiver element and the image donor element is a thermal dye donor element.

20. A method of forming a dye image comprising:

thermally transferring a dye image from a thermal dye donor element to the imaging element of any of embodiments 1 to 17 that is a thermal dye transfer receiver element.

The following examples are provided to illustrate the invention. In all the examples the support was created as follows.

EXAMPLES

Substrate:

The elements described in the Invention and Comparative Examples basically comprised a raw paper base having thereon, an extruded resin compliant layer, a polyester skin layer on the image side the raw paper base and with a polyolefin resin layer on the backside of the raw paper base.

The raw paper base was a photographic grade raw base with a basis weight of 174.5 g/m$^2$ and a thickness of 169.95 μm.

The backside or non-image side of the raw base was resin-coated against a matte chill roll with non-pigmented polyethylene, which was a 50/50 wt. ratio blend of high density polyethylene (HDPE) and low density polyethylene (LDPE). The HDPE resin was an 8 melt flow rate (ASTM D1238) Chevron Phillips PE9608 (density of 962 kg/m$^3$) and the LDPE resin was a 4.15 melt flow rate (ASTM D1238) Dow Chemical LDPE 50041 (density of 924 kg/m$^3$).

The image side of the raw paper base was coated in a co-extruded format with a compliant layer and a skin layer to produce a bi-layer structure using a 0.0635 m single screw extruder along with a 0.0254 m single screw extruder. An appropriate feedplug configuration in the Cloeren coextrusion feedblock was used. The compliant layer and skin layer resins were delivered to the feedblock that then fed the resins to a die. The layers were coextruded through a die with a die gap set around 0.46 mm and whose width was about 1270 mm, and onto the raw paper base. The distance between the die exit and the nip formed by the chill roll and the pressure roll was about 120 mm. The chill roll used for coating the image side resin was smooth glossy and the coating speed was maintained at 75.76 m/min.

Compliant Layer:

The compliant layer comprised a matrix polymer, an elastomeric polymer, an amorphous or semi-crystalline polymer additive, and an inorganic additive that acts as an opacifier. Specifically, the compliant layer comprised Dow chemical Amplify™ EA102 (ethylene ethyl acrylate copolymer as the matrix polymer), Kraton® G1657 elastomeric polymer, and America's Styrenics MC3700 (polystyrene, amorphous additive) or Flint Hills resources P9H8M015 (polypropylene, semi-crystalline additive), and titanium dioxide as the opacifier. The compliant layer resin was created by compounding the resins, the opacifier, and a small quantity of other addenda such as antioxidant (Irganox® from Ciba) and processing aid (zinc stearate) in a Leistritz ZSK27 compounder.

Dye Receiving Layer:

The dye receiving layer comprised a polyester that was either a branched polyester E2 whose structure and synthesis are described in U.S. Pat. No. 6,897,183 (col. 15, lines 3-32) and U.S. Pat. No. 7,091,157 (col. 31, lines 23-51), both incorporated herein by reference, or a commercial polyester, Vylon 290, from Toyobo company. The glass transition temperature of E2 was 55° C. and that of Vylon 290 was 72° C. The dye receiving layer resin was dried before extrusion in a Novatech desiccant dryer at 43° C. for 24 hours. The dryer was equipped with a secondary heat exchanger so that the temperature will not exceed 43° C. during the time that the desiccant was recharged. The dew point was −40° C.

Details of the substrate, extruded compliant layer, and extruded dye receiving layer(s) are provided below in TABLE I.

TABLE I

| Substrate | Raw Base, g/m$^2$, Thickness (μm) | Backside Resin (g/m$^2$) | Image Side Resin (g/m$^2$) Compliant Layer | Image Side Resin (g/m$^2$) Dye Receiving Layer |
|---|---|---|---|---|
| A | 174.5 g/m$^2$, 169.95 μm | 50% HDPE 9608, 50% LDPE 4002P @ 14.65 g/m$^2$ | 53.6% Amplify EA102, 25.05% Kraton ™ G1657, 11% polystyrene MC3700, 10% $TiO_2$, 0.25% zinc stearate, 0.1% Irganox ® 1076 @ 24.4 g/m$^2$ | Branched polyester E2 @ 12.21 g/m$^2$ |
| B | 174.5 g/m$^2$, 169.95 μm | 50% HDPE 9608, 50% LDPE 4002P @ 14.65 g/m$^2$ | 53.6% Amplify EA102, 25.05% Kraton ™ G1657, 11% polystyrene MC3700, 10% $TiO_2$, 0.25% zinc stearate, 0.1% Irganox ® 1076 @ 24.4 g/m$^2$ | Branched polyester E2 @ 6.59 g/m$^2$ |
| C | 174.5 g/m$^2$, 169.95 μm | 50% HDPE 9608, 50% LDPE 4002P @ 14.65 g/m$^2$ | 53.6% Amplify EA102, 25.05% Kraton ™ G1657, 11% polystyrene MC3700, 10% $TiO_2$, 0.25% zinc stearate, 0.1% Irganox ® 1076 @ 24.4 g/m$^2$ | Branched polyester E2 @ 2.2 g/m$^2$ |
| D | 174.5 g/m$^2$, 169.95 μm | 50% HDPE 9608, 50% LDPE 4002P @ 14.65 g/m$^2$ | 53.6% Amplify EA102, 25.05% Kraton ™ G1657, 11% polypropylene P9H8M015, 10% $TiO_2$, 0.25% zinc stearate, 0.1% Irganox ® 1076 @ 24.4 g/m$^2$ | Vylon 290 @ 12.21 g/m$^2$ |

Comparative Examples

Comparative image receiving elements contained the elements of TABLE I but the aqueous topcoat was omitted. These are listed below in TABLE II.

TABLE II

| Comparative Examples | Substrate | Topcoat |
|---|---|---|
| 1 | A | None |
| 2 | B | None |
| 3 | C | None |
| 4 | D | None |

Invention Examples

The image side of the substrates listed in TABLE I was corona discharge treated and coated with various topcoats from aqueous coating compositions and dried to form the image receiving elements of the invention. The main ingredients used in various aqueous topcoats are as follows:

| | |
|---|---|
| (a) AQ55D | Polyester ionomer dispersion from Eastman Chemicals with a $T_g$ of 55° C. |
| (b) Neorez R600 | Polyurethane dispersion from DSM Neoresins |
| (c) Latex A | Polyurethane dispersion comprising siloxane moiety prepared as described below |
| (d) FS 10D | Conductive acicular tin oxide dispersion from Ishihara |
| (e) Hitac RA-14 | Modified polyurethane dispersion from Hitac Adhesives and Coatings |
| (f) ML 156 | Carnauba wax dispersion from Michelman |
| (g) Cymel ® 303 | Methylated melamine resin from Cytec Corporation |
| (h) CX100 | Polyaziridine from DSM Neoresins |

Preparation of Latex A:

In a 5-liter, three-necked round bottom flask equipped with a stirrer, water condenser, and nitrogen inlet were placed 116.34 g (0.058 moles) of Terathane polyether polyol (average Mn=2000) (Aldrich Chemicals) followed by 119.38 g (0.89 moles) of 2,2-bis(hydroxymethyl)-propionic acid (DMPA), 52.0 g (0.052 moles) of Silaplane/Mono-terminal Chisso Siloxane FM-DA11, (average Mw=1000), 600 g of tetrahydrofuran (THF), and 1.25 g of dibutyltin dilaurate (catalyst). The temperature was adjusted to 65° C. When a homogenous solution was obtained, 211.16 g (0.95 moles) of isophrone diisocyanate (IPDI) were slowly added followed by 10 g of THF. The temperature was raised to 75° C. and maintained for 24 hours to complete the reaction, resulting in an intermediate containing no residual free isocyanate. The free isocyanate content was monitored by the disappearance of the NCO absorption peak by infrared spectroscopy.

The reaction mixture was diluted with THF and neutralized with triethylamine to 100% stoichiometric neutralization of the carboxylic acid, followed by the addition of 1500 g of distilled water under high shear to form a stable aqueous dispersion. THF was removed by heating under vacuum, and the resultant aqueous dispersion was filtered. The polyurethane obtained had an Mw of about 23,900 and acid number of about 100.

Details of the Invention Examples are provided in TABLE III.

TABLE III

| Invention Examples | Substrate | Topcoat Composition (dry wt. %) AQ55D | Neorez R600 | Latex A | FS10D | RA 14 | ML 156 | Cymel ® 303 | CX100 | Topcoat Coverage (g/m$^2$) |
|---|---|---|---|---|---|---|---|---|---|---|
| 1 | A | 63.9 | 3.5 | 3.5 | 23.6 | | | 4.8 | 0.7 | 0.536 |
| 2 | A | 63.9 | 3.5 | 3.5 | 23.6 | | | 4.8 | 0.7 | 1.076 |
| 3 | A | 77.9 | 4.3 | 4.3 | 7.0 | 0.5 | | 5.8 | 0.2 | 1.076 |
| 4 | B | 73.5 | 8.6 | 4.3 | 7.0 | 0.5 | | 5.5 | 0.6 | 1.076 |
| 5 | C | 73.5 | 8.6 | 4.3 | 7.0 | 0.5 | | 5.5 | 0.6 | 1.076 |
| 6 | C | 64.8 | 14.4 | 7.2 | 7.0 | 0.5 | | 5.5 | 0.6 | 1.076 |
| 7 | D | 51.4 | 5.7 | | 26.9 | | 11.5 | 3.9 | 0.6 | 0.387 |
| 8 | D | 51.4 | 5.7 | | 26.9 | | 11.5 | 3.9 | 0.6 | 0.194 |
| 9 | D | 34.3 | 3.8 | | 38.1 | | 20.8 | 2.6 | 0.4 | 0.215 |

The Comparative and Invention Examples were evaluated for printability in a Kodak® Photo Printer 6850 using a Kodak Professional EKTATHERM ribbon, catalogue number 106-7347 coated with cyan, magenta, and yellow dyes in cellulose acetate propionate binder and a poly(vinyl acetal)-based protective overcoat. The results are provided below in TABLE IV.

TABLE IV

| Examples | Printability |
|---|---|
| Comparative 1 | Not printable because of sticking and donor welding |
| Comparative 2 | Not printable because of sticking and donor welding |
| Comparative 3 | Not printable because of sticking and donor welding |
| Comparative 4 | Not printable because of sticking and donor welding |
| Invention 1 | Printable without sticking |
| Invention 2 | Printable without sticking |
| Invention 3 | Printable without sticking |
| Invention 4 | Printable without sticking |
| Invention 5 | Printable without sticking |
| Invention 6 | Printable without sticking |

TABLE IV-continued

| Examples | Printability |
|---|---|
| Invention 7 | Printable without sticking |
| Invention 8 | Printable without sticking |
| Invention 9 | Printable without sticking |

It is clear from the data in TABLE IV that none of the Comparative Examples without an aqueous topcoat could be printed because of sticking caused by the donor being stuck to the receiving element so that the donor could not be separated from the image receiving element. On the other hand, the Invention image receiving elements, having an aqueous topcoat, were printed without sticking, demonstrating the advantages of the invention. Microscopy of some of the printed ($D_{max}$) samples from the present invention revealed that the dye penetrated about 2 μm from the topcoat (~0.8 μm thick) surface into the extruded image receiving layer. This demonstrates that the extruded image receiving layer was capable of receiving an image but was not directly printable without the presence of the aqueous-coated topcoat.

The $D_{max}$ optical density (read by a densitometer) for the red, green, and blue records for some of the Invention Examples were measured and are listed below in TABLE V.

TABLE V

| Example | $D_{max}$ (Red) Optical Density | $D_{max}$ (Green) Optical Density | $D_{max}$ (Blue) Optical Density |
|---|---|---|---|
| Invention 3 | 2.1 | 1.9 | 1.9 |
| Invention 4 | 2.2 | 2.1 | 2.0 |
| Invention 5 | 2.1 | 2.0 | 1.9 |
| Invention 6 | 2.1 | 2.1 | 1.9 |
| Invention 7 | 2.1 | 1.9 | 1.8 |
| Invention 8 | 2.2 | 2.0 | 1.9 |
| Invention 9 | 2.2 | 2.1 | 2.0 |

It is clear from the data in TABLE V that the image receiving elements of this invention, having the aqueous topcoat, provided prints with desirably high optical density.

The invention has been described in detail with particular reference to certain preferred embodiments thereof, but it will be understood that variations and modifications can be effected within the spirit and scope of the invention.

The invention claimed is:

1. An image receiving element comprising a substrate and having thereon an extruded compliant layer, an extruded image receiving layer, and a topcoat immediately adjacent the extruded image receiving layer, wherein:

the extruded image receiving layer is non-crosslinked and has a transition temperature ($T_g$) of from about 40° C. to about 80° C., the topcoat is an aqueous-coated layer and has a polymer that has a $T_g$ that is within a range of plus or minus 20° C. of the $T_g$ of the extruded image receiving layer, which polymer comprises at least 20 weight % of the total polymers in the topcoat, and the dry thickness ratio of the topcoat to the extruded image receiving layer is from 1:2 to 1:100.

2. The element of claim 1 wherein the topcoat comprises a crosslinked polyester.

3. The element of claim 1 wherein the topcoat comprises a polyurethane or a polyurea.

4. The element of claim 1 wherein the topcoat has a polymer that has a $T_g$ that is within a range of plus or minus 10° C. of the $T_g$ of the extruded image receiving layer, and the dry thickness ratio of the topcoat to the extruded image receiving layer is from 1:2 to 1:75.

5. The element of claim 1 wherein the topcoat comprises a crosslinked polyester and the extruded image receiving layer comprises a non-crosslinked polyester that is an aliphatic polyester, aromatic-aliphatic polyester copolymers, or an alicyclic polyester.

6. The element of claim 1 wherein the extruded image receiving layer comprises a non-crosslinked aliphatic polyester or blend of an aliphatic polyester that is a polylactic acid, polybutylene succinate, or polyhydroxyalkanoates, aliphatic-aromatic copolyester, alicylic polyester, or a polyester comprising: (a) recurring dibasic acid derived units and diol derived units, at least 50 mole % of the dibasic acid derived units comprising dicarboxylic acid derived units containing an alicyclic ring comprising 4 to 10 ring carbon atoms, which ring is within two carbon atoms of each carboxyl group of the corresponding dicarboxylic acid, (b) 25 to 75 mole % of the diol derived units containing an aromatic ring not immediately adjacent to each hydroxyl group of the corresponding diol or an alicyclic ring, and (c) 25 to 75 mole % of the diol derived units of the polyester contain an alicyclic ring comprising 4 to 10 ring carbon atoms.

7. The element of claim 1 wherein the substrate comprises a raw paper base support.

8. The element of claim 1 wherein the substrate comprises a synthetic paper base.

9. The element of claim 1 wherein the extruded compliant layer comprises an elastomeric polymer that is present in an amount of from about 15 to about 50 weight %.

10. The element of claim 9 wherein the elastomeric polymer comprises a thermoplastic polyolefin blend, styrene/alkylene block copolymer, polyether block polyamide, copolyester elastomer, ethylene/propylene copolymer, or thermoplastic urethane, or a mixture thereof.

11. The element of claim 9 wherein the extruded compliant layer comprises from about 35 to about 80 weight % of a matrix polymer, from about 15 to about 40 weight % of the elastomeric polymer, and from about 2 to about 25 weight % of an amorphous or semi-crystalline polymer additive.

12. The element of claim 1 wherein the extruded compliant layer is a voided or foamed compliant layer.

13. The element of claim 1 further comprising an extruded skin layer immediately adjacent either or both sides of the extruded compliant layer.

14. The element of claim 13 wherein the extruded skin layer(s) and extruded compliant layer are co-extruded layers.

15. The element of claim 1 wherein the image receiving layer, extruded compliant layer, and optional extruded skin layer(s) are co-extruded on the support.

16. The element of claim 1 wherein the image receiving layer is a thermal dye transfer image receiving layer and the element is a thermal dye transfer receiver element.

17. The element of claim 1 wherein the image receiving layer consists essentially of a non-crosslinked aliphatic polyester.

18. An assembly comprising the imaging element of claim 1 and an image donor element.

19. The assembly of claim 18 wherein the imaging element is a thermal dye transfer receiver element and the image donor element is a thermal dye donor element.

20. A method of forming a dye image comprising:

thermally transferring a dye image from a thermal dye donor element to the imaging element of claim 1 that is a thermal dye transfer receiver element.

* * * * *